US010665400B2

(12) United States Patent
Koyama et al.

(10) Patent No.: US 10,665,400 B2
(45) Date of Patent: May 26, 2020

(54) TRIGGER SWITCH

(71) Applicant: Omron Corporation, Kyoto (JP)

(72) Inventors: Taiki Koyama, Okayama (JP); Makito Morii, Okayama (JP); Koji Omori, Okayama (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 16/327,138

(22) PCT Filed: Aug. 21, 2017

(86) PCT No.: PCT/JP2017/029736
§ 371 (c)(1),
(2) Date: Feb. 21, 2019

(87) PCT Pub. No.: WO2018/061519
PCT Pub. Date: May 4, 2018

(65) Prior Publication Data

US 2019/0228926 A1 Jul. 25, 2019

(30) Foreign Application Priority Data

Sep. 27, 2016 (JP) ..... 2016-188739

(51) Int. Cl.
*H01H 13/04* (2006.01)
*H01H 13/60* (2006.01)
(Continued)

(52) U.S. Cl.
CPC ..... *H01H 13/04* (2013.01); *B25F 5/00* (2013.01); *B25F 5/006* (2013.01); *B25F 5/02* (2013.01); *H01H 9/102* (2013.01); *H01H 13/60* (2013.01)

(58) Field of Classification Search
CPC ..... H01H 13/04; H01H 9/02; H01H 13/60; B25F 5/00; B25F 5/006; B25F 5/02
(Continued)

(56) References Cited

U.S. PATENT DOCUMENTS 4,588,910 A * 5/1986 Bausch ..... H01H 9/063 200/1 V
7,297,891 B2 * 11/2007 Omori ..... H01H 3/48 200/522
7,401,663 B2 * 7/2008 Craven ..... B25F 5/001 173/171
(Continued)

FOREIGN PATENT DOCUMENTS

CN 1514683 A 7/2004
CN 101965248 A 2/2011
(Continued)

OTHER PUBLICATIONS

International Search Report issued in Application No. PCT/JP2017/029736, dated Oct. 17, 2017 (5 pages).
(Continued)

*Primary Examiner* — Edwin A. Leon
(74) *Attorney, Agent, or Firm* — Osha Liang LLP

(57) ABSTRACT

A trigger switch has a switch housing fixed inside a tool housing of an electric power tool and internally having a holder, an operation unit provided outside the switch housing and connected to the switch housing so as to be approachable to and separable from the switch housing, a fixed contact provided in the holder, and a movable contact provided so as to face the fixed contact in the holder and configured to come into contact with and separate from the fixed contact in conjunction with an approaching motion and a separating motion of the operation unit with respect to the switch housing. A vibration damping elastic body is provided integrally on an outer surface of the switch housing.

19 Claims, 9 Drawing Sheets

(51) Int. Cl.
*B25F 5/02* (2006.01)
*B25F 5/00* (2006.01)
*H01H 9/10* (2006.01)

(58) Field of Classification Search
USPC ..... 200/522
See application file for complete search history.

(56) References Cited

U.S. PATENT DOCUMENTS

| | | | | |
|---|---|---|---|---|
| 7,721,818 | B2 * | 5/2010 | Inagawa | B25F 5/006 173/162.1 |
| 2004/0188120 | A1 | 9/2004 | Komatsu et al. | |
| 2006/0186102 | A1 | 8/2006 | Inagaki et al. | |
| 2010/0314147 | A1 | 12/2010 | Muller et al. | |
| 2013/0105188 | A1 | 5/2013 | Sakamaki et al. | |

FOREIGN PATENT DOCUMENTS

| | | | |
|---|---|---|---|
| EP | 2602065 | A2 | 6/2013 |
| JP | S53-141483 | U | 11/1978 |
| JP | S61-142338 | U | 9/1986 |
| JP | H4-112417 | U | 9/1992 |
| JP | 2010-192452 | A | 9/2010 |
| JP | 2013-94911 | A | 5/2013 |

OTHER PUBLICATIONS

Written Opinion issued in International Application No. PCT/JP2017/029736, dated Oct. 17, 2017 (8 pages).
Office Action issued in Chinese Application No. 201780049182.3; dated Sep. 2, 2019 (18 pages).

* cited by examiner

TRIGGER SWITCH

BACKGROUND

Technical Field

The present invention relates to a trigger switch used in an electric power tool.

Related Art

The trigger switch disclosed in Patent Document 1 includes a first housing and a second housing in which a switch mechanism is incorporated, and an operation unit that can be operated by a user with a finger and transmits an operational motion to the switch mechanism.

Patent Document 1: Japanese Unexamined Patent Publication No. 2010-192452

SUMMARY OF THE INVENTION

In the trigger switch, a switch mechanism is used to improve vibration resistance, the switch mechanism having a structure in which two movable contacts are simultaneously press-fit to two fixed contacts while resisting the urging force of springs. However, due to the recent increase in capacity and power of electric power tools, there have been more cases where such a switch mechanism cannot sufficiently prevent the occurrence of chattering.

One or more embodiments of the present invention provides a trigger switch capable of improving vibration resistance.

A trigger switch of one aspect of the present invention includes: a switch housing fixed inside a tool housing of an electric power tool and internally having a holder; an operation unit provided outside the switch housing and connected to the switch housing so as to be approachable to and separable from the switch housing; a fixed contact provided in the holder; and a movable contact provided so as to face the fixed contact in the holder and configured to come into contact with and separate from the fixed contact in conjunction with an approaching motion and a separating motion of the operation unit with respect to the switch housing. A vibration damping elastic body is provided integrally on an outer surface of the switch housing.

According to the trigger switch of the above aspect, the vibration damping elastic body is provided on the outer surface of the switch housing, thereby enabling improvement in vibration resistance.

DETAILED DESCRIPTION

Hereinafter, embodiments of the present invention will be described with reference to the accompanying drawings. In the following description, terms (e.g., terms including "upper", "lower", "right", "left", "side", and "end") indicating specific directions or positions are used as necessary, but the use of these terms is for facilitating understanding of the invention with reference to the drawings, and the technical scope of the present invention is not limited by the meaning of these terms. The following description is merely exemplary in nature and is not intended to limit the present invention, its application, or its usage. Further, the drawings are schematic, and ratios of dimensions and the like do not necessarily agree with actual ones. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

As illustrated in FIGS. 1 to 4, the trigger switch 20 according to one embodiment of the present invention is fixed in a tool housing 10 made of resin, for example, and constitutes the electric power tool 1 together with the tool housing 10. In FIGS. 1 to 4, components constituting the electric power tool 1 other than the trigger switch 20 are omitted.

Figure 1:
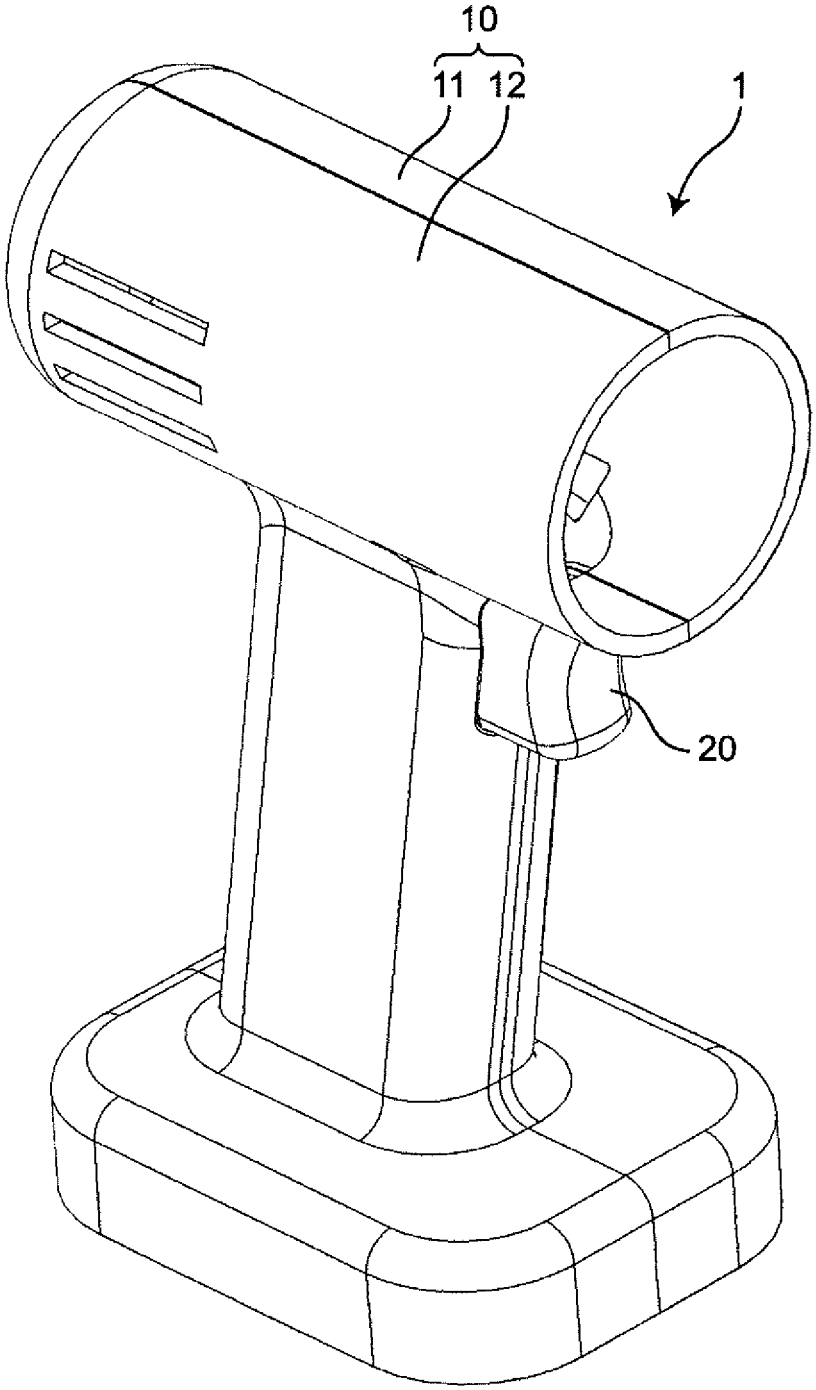
FIG. 1 is a perspective view of an electric power tool provided with a trigger switch according to one embodiment of the present invention.
Figure 2:
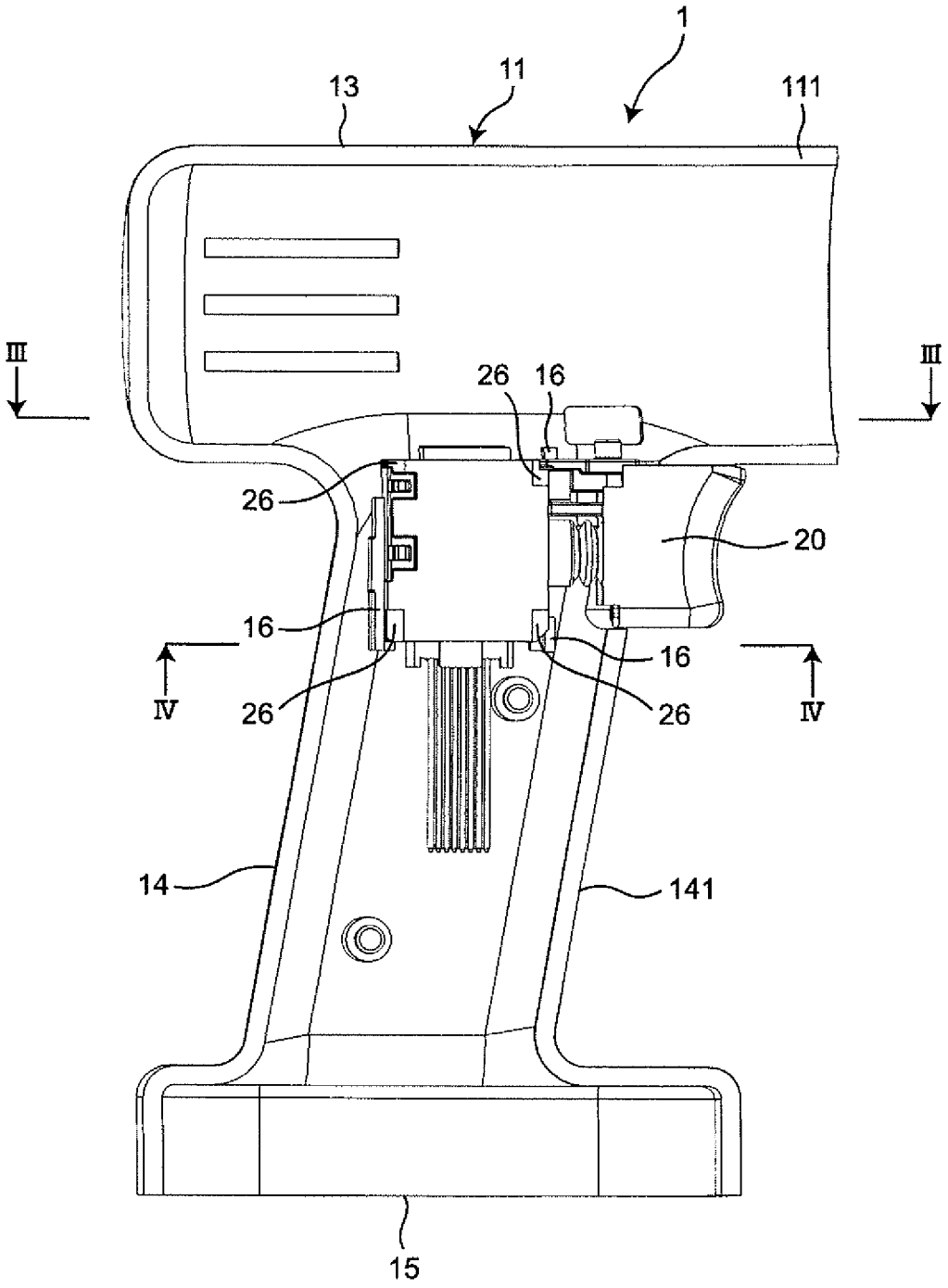
FIG. 2 is a side view of the electric power tool in FIG. 1 with a part of a tool housing removed.

As illustrated in FIG. 1, the tool housing 10 is made up of a right housing 11 and a left housing 12 joined to the right housing 11. The right housing 11 and the left housing 12 are provided symmetrically with respect to a joining surface (FIG. 2 only shows a joining surface 111 of the right housing 11). As illustrated in FIG. 2, the tool housing 10 includes a drive mechanism holder 13, a trigger switch holder 14, and a battery holder 15. Note that FIG. 2 illustrates the electric power tool 1 with the left housing 12 removed.

A drive mechanism part (not illustrated) such as a motor, electrically connected to the trigger switch 20, is accommodated inside the drive mechanism holder 13. The trigger switch holder 14 extends downward from substantially the center in the horizontal direction of the drive mechanism holder 13 in FIG. 2, and the trigger switch 20 is accommodated inside the trigger switch holder 14. The outer surface of the trigger switch holder 14 constitutes a grip part 141 gripped by a user. The battery holder 15 is connected to the lower end of the trigger switch holder 14, and a battery (not illustrated) electrically connected to the trigger switch 20 is accommodated inside the battery holder 15.

Figure 3:
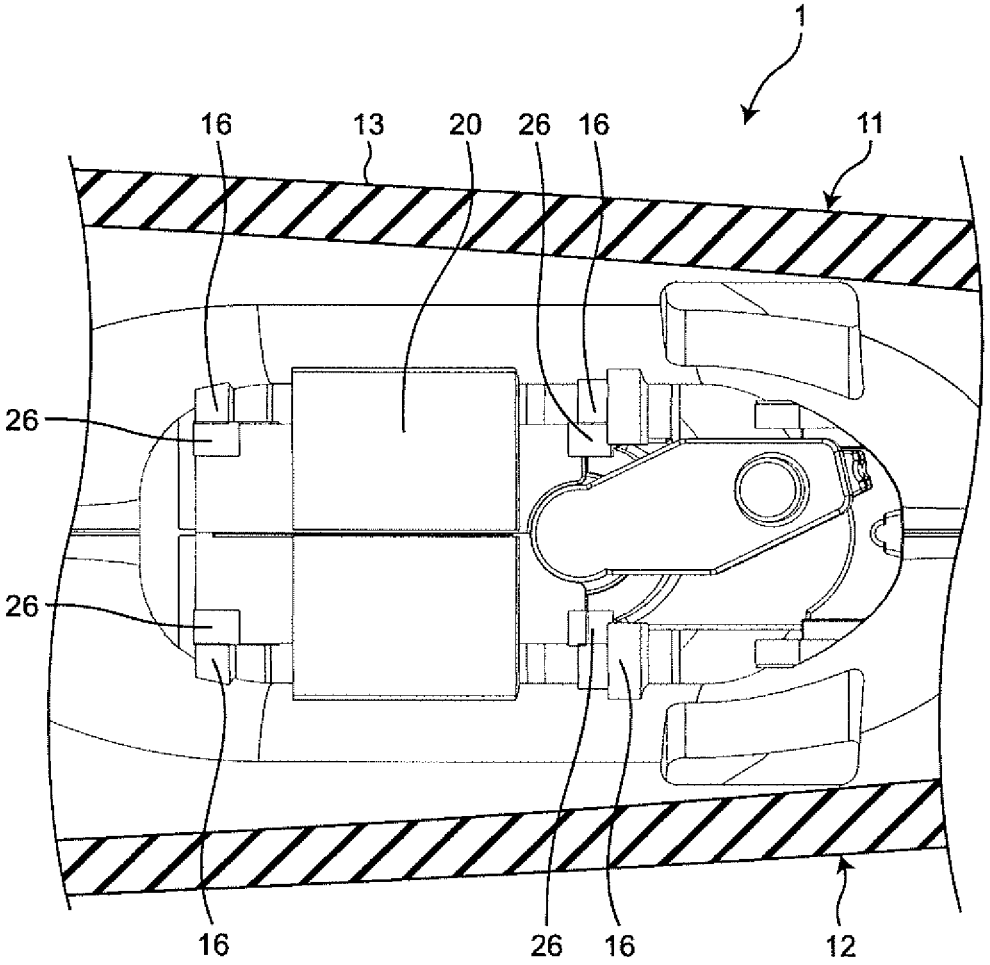
FIG. 3 is a sectional view taken along line III-III in FIG. 2.
Figure 4:
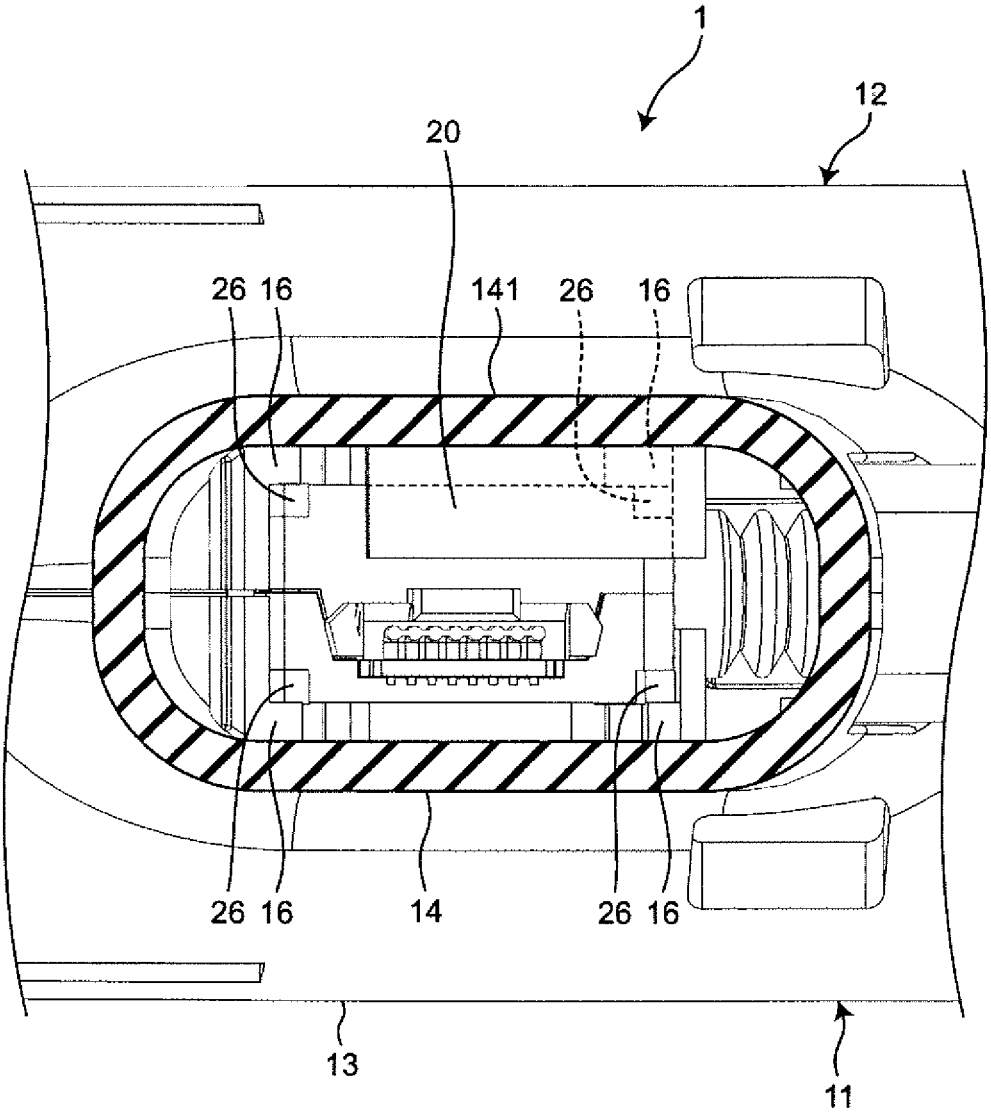
FIG. 4 is a sectional view taken along line IV-IV in FIG. 2.

A trigger switch fixing unit 16 for fixing the trigger switch 20 is provided at the end in the trigger switch holder 14 on the drive mechanism holder 13 side. As illustrated in FIGS. 3 and 4, the trigger switch fixing unit 16 is in contact with a corner of a rectangular box-shaped switch housing 21 of a trigger switch 20 to be described later to fix the trigger switch 20 in the tool housing 10.

Figure 5:
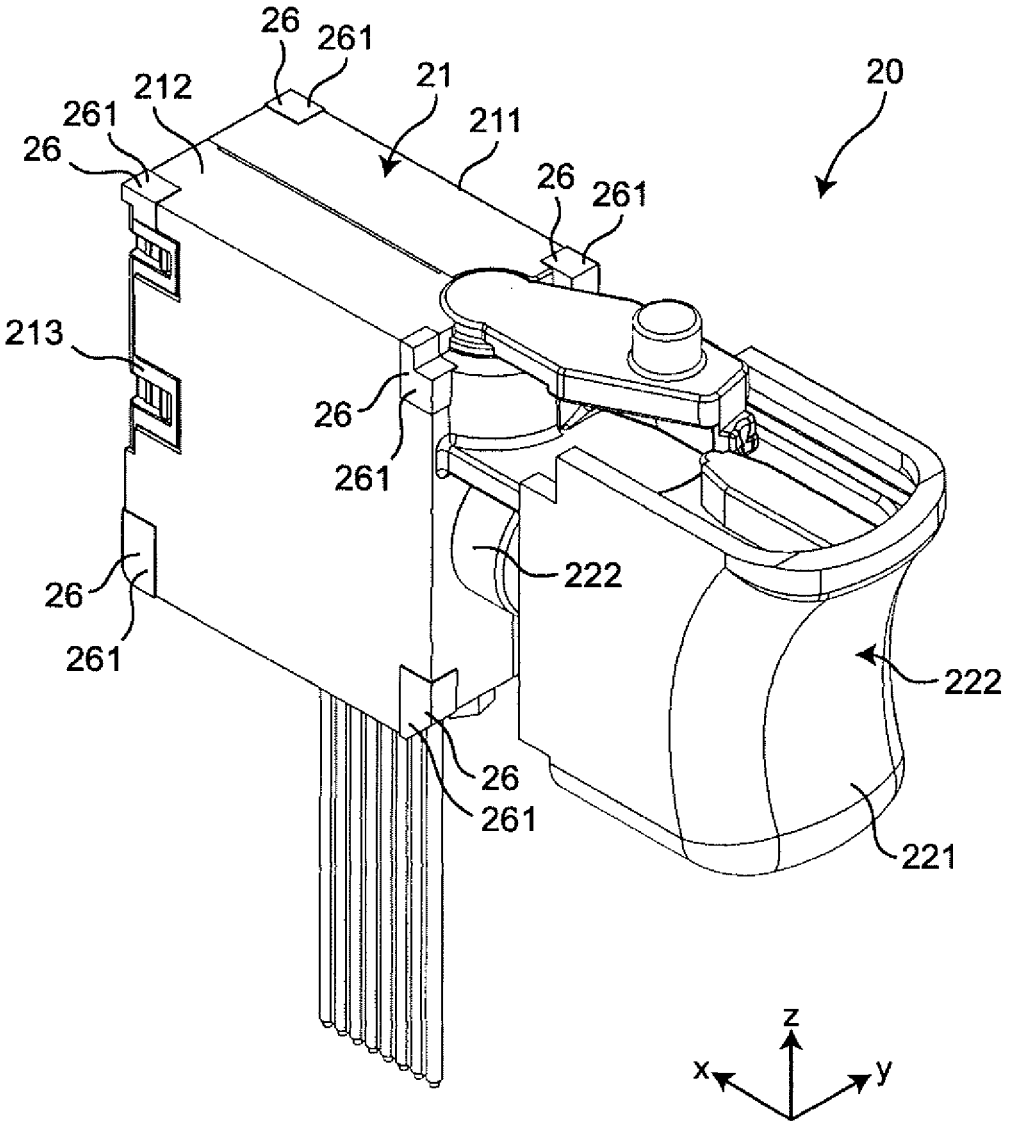
FIG. 5 is a perspective view of a trigger switch according to an embodiment of the present invention.
Figure 7:
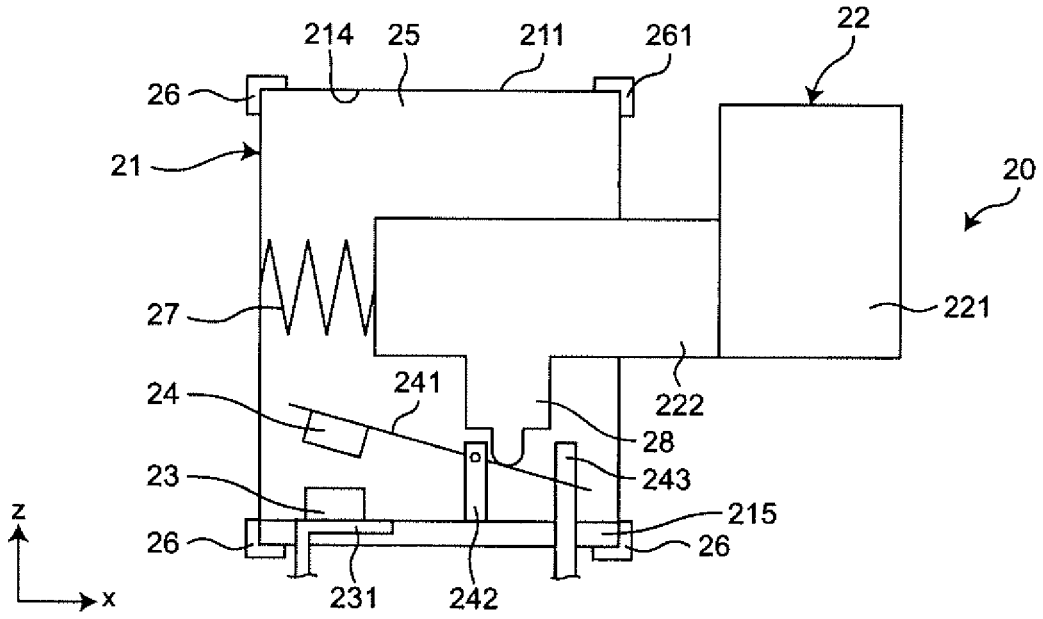
FIG. 7 is a schematic diagram illustrating a returned state of the trigger switch in FIG. 5 with a part of the switch housing removed.
Figure 8:
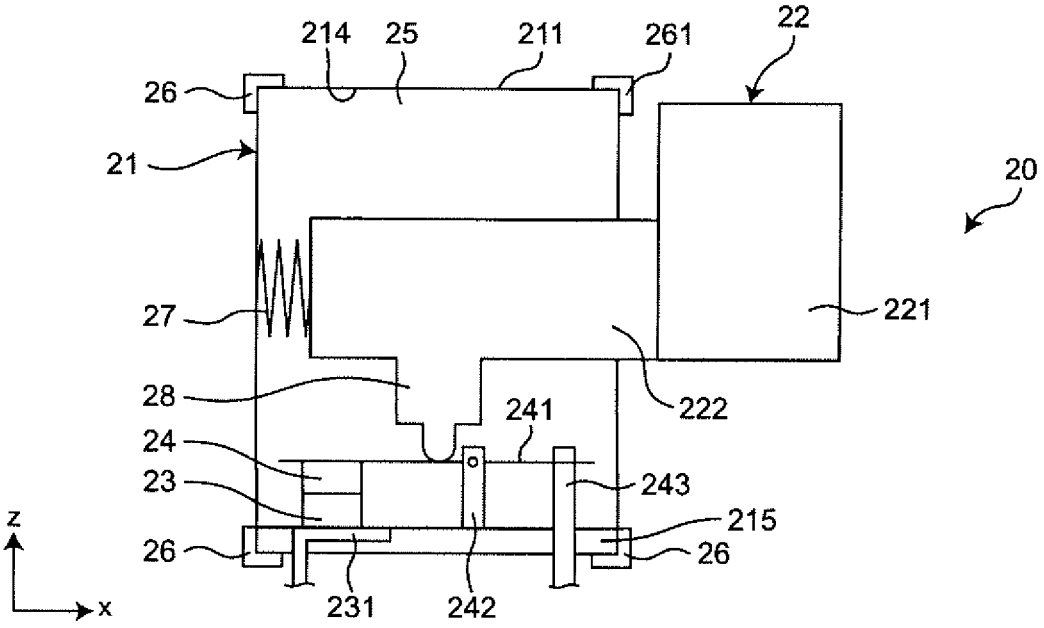
FIG. 8 is a schematic diagram illustrating an operating state of the trigger switch in FIG. 5 with a part of the switch housing removed.

As illustrated in FIG. 5, the trigger switch 20 includes a switch housing 21 made of resin and a trigger 22 as an example of an operation unit. Inside the switch housing 21, as illustrated in FIGS. 7 and 8, a holder 25 is provided, and a fixed contact 23 and a movable contact 24 are provided in the holder 25. Note that FIGS. 7 and 8 schematically illustrate the trigger switch 20 in a state where a second housing 212 to be described later has been removed.

Figure 6:
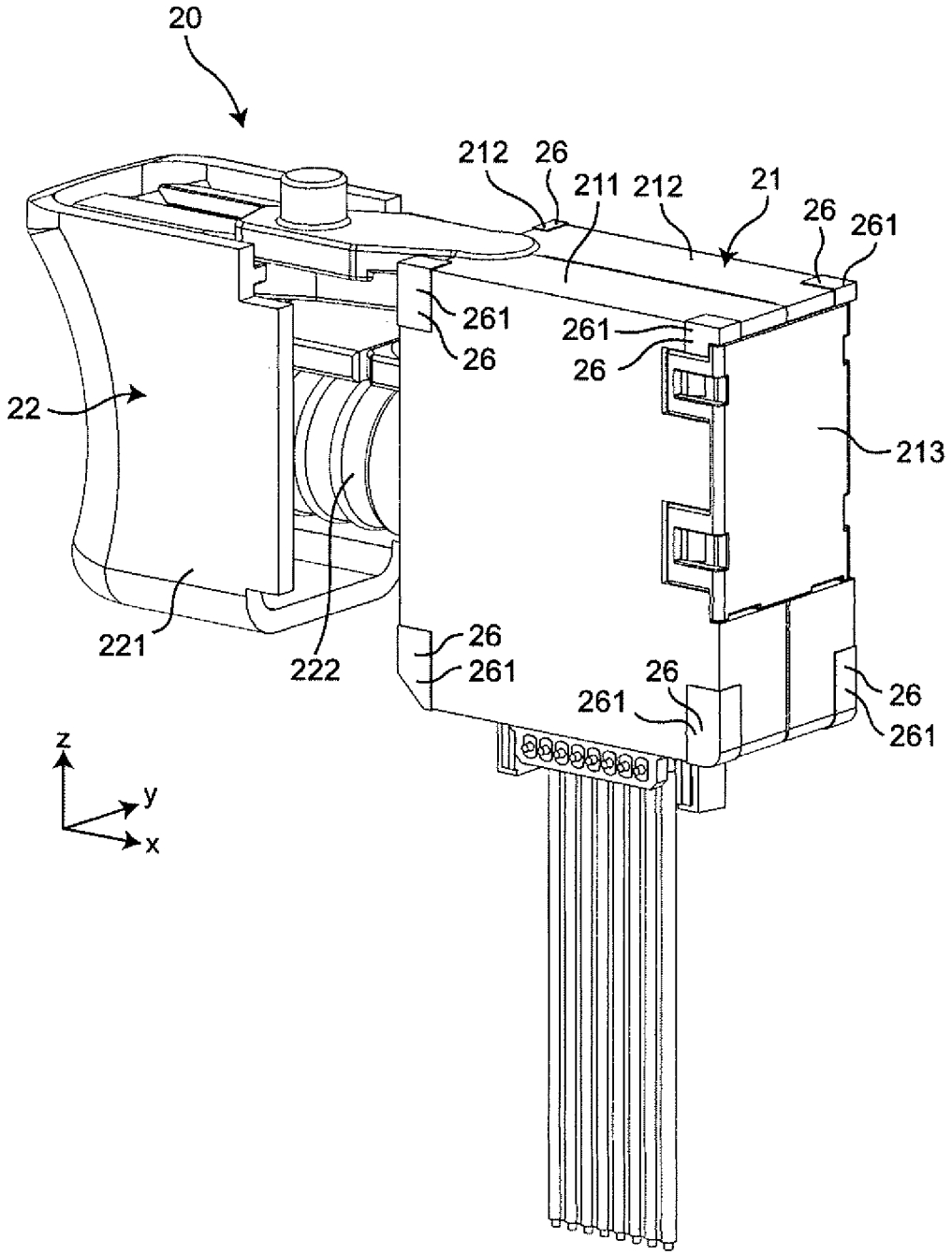
FIG. 6 is a perspective view of the trigger switch in FIG. 5 as seen from a direction different from FIG. 5.

As illustrated in FIGS. 5 and 6, the switch housing 21 is made up of a first housing 211 having an opening 214 (illustrated in FIGS. 7 and 8) on one surface, and a second housing 212 joined in the width direction of the first housing 211 (i.e., the Y direction in FIG. 5) and closing the opening 214. A part of the joining surface of the first housing 211 and the second housing 212 is covered with the sub second housing 213.

Each of the first housing 211 and the second housing 212 has a rectangular box shape and is provided symmetrically with respect to mutual joining surfaces. A trigger 22 is disposed on the right side of the first housing 211 and the second housing 212 in the short direction (i.e., the X direction in FIG. 5). As illustrated in FIG. 6, the sub second housing 213 has a substantially plate shape and is attached to the left-side surface in the short direction of the first housing 211 and the second housing 212 (i.e., on the surface farther from the trigger 22).

Each of the eight corners of the outer surface of the switch housing 21 has a tool housing fixing unit 261 that comes into contact with the tool housing 10 and is fixed to the tool housing 10 when fixed in the tool housing 10. A vibration damping elastic body 26 is provided in each tool housing fixing unit 261.

Each of the vibration damping elastic bodies 26 is, for example, an elastomer having a thickness of 1 mm, and is provided integrally with the switch housing 21 by two-color molding on three surfaces constituting each corner of the switch housing 21. Each of the vibration damping elastic bodies 26 is provided independently of each other and is interposed between the switch housing 21 and the tool housing 10 when fixed in the tool housing 10 of the electric power tool 1, so that the switch housing 21 and the tool housing 10 do not come into direct contact with each other. The vibration damping elastic body 26 absorbs vibration generated by rotation of the motor of the electric power tool 1 or the like and transmitted to the tool housing 10, to suppress vibration propagated from the three directions to the trigger switch 20.

As illustrated in FIGS. 5 and 6, the trigger 22 includes an operation body 221 operated by the user with the finger, and an operation shaft 222 extending from the surface of the operation body 221, facing the switch housing 21, toward the switch housing 21 to the inside of the switch housing 21. The trigger 22 is provided outside the switch housing 21 and is connected to the switch housing 21 so as to be approachable to and separable from the switch housing 21.

The operation body 221 has a curved surface on the surface opposite to the surface on which the operation shaft 222 is provided (the right-side surface in the X direction in FIG. 5), so that the operation body 221 can be easily operated with the user's finger.

As illustrated in FIGS. 7 and 8, one end of the operation shaft 222 in the longitudinal direction (i.e., the right-side end in the X direction in FIGS. 7 and 8) is positioned outside the switch housing 21 and connected to the operation body 221, whereas the other end of the operation shaft 222 in the longitudinal direction (i.e., the left-side end in the X direction in FIGS. 7 and 8) is positioned in the holder 25 of the switch housing 21 and is movably connected to the switch housing 21. On the left side of the operation shaft 222 in the longitudinal direction, a return spring 27 is disposed in a state where the operation shaft 222 can be urged toward the right in the longitudinal direction.

The operation shaft 222 is provided with a plunger 28 that extends downward from the operation shaft 222 in the holder 25 (i.e., downward in the Z direction in FIGS. 7 and 8). In conjunction with the movement of the trigger 22, the tip of the plunger 28 (i.e., the lower end in the Z direction in FIGS. 7 and 8) is disposed so as to be able to come into contact with a movable contact piece 241 to be described later.

As illustrated in FIGS. 7 and 8, the fixed contact 23 is attached to a fixed-contact-side terminal 231 fixed to the left end of a wall 215 on the lower side of the switch housing 21 (i.e., the lower side in the Z direction in FIGS. 7 and 8). The movable contact 24 is attached to a movable contact piece 241 turnably supported by a support 242 provided at a substantially center in the X direction of the bottom surface in the holder 25. The movable contact 24 faces the fixed contact 23 and is disposed so as to be capable of coming into contact with and separating from the fixed contact 23. The movable contact piece 241 extends in the short direction of the switch housing 21 (i.e., the X direction in FIGS. 7 and 8) in the holder 25, and the movable contact 24 is attached to the left-side end in the short direction. The right-side end in the short direction of the movable contact piece 241 is in contact with a movable-contact-side terminal 243 fixed to the right end of the lower wall 215 of the switch housing 21.

Next, the operation of the trigger switch 20 will be described with reference to FIGS. 7 and 8.

Note that FIG. 7 illustrates the trigger switch 20 in a returned state where the fixed contact 23 and the movable contact 24 are separated. Further, FIG. 8 illustrates the trigger switch 20 in an operating state where the fixed contact 23 and the movable contact 24 are in contact with each other.

In the returned state illustrated in FIG. 7, the end of the movable contact piece 241, at which the movable contact 24 is provided, is separated from the lower wall 215 of the switch housing 21 more than the end in contact with the movable-contact-side terminal 243, thereby separating movable contact 24 from the fixed contact 23.

When the operation body 221 of the trigger 22 of the trigger switch 20 in the returned state is operated with the finger to bring the trigger 22 close to the switch housing 21, the plunger 28 moves to the left side in the X direction in conjunction with the movement of the trigger 22. As a result, the plunger 28 comes into contact with the movable contact piece 241 on the side closer to the movable contact 24 than the support 242 of the movable contact piece 241, and turns the movable contact piece 241 counterclockwise. As a result, the end of the movable contact piece 241, at which the movable contact 24 is provided, approaches the lower wall 215 of the switch housing 21, and the movable contact 24 comes into contact with the fixed contact 23, whereby the operating state becomes the one illustrated in FIG. 8.

When the finger is released from the operation body 221 of the trigger 22 of the trigger switch 20 in the operating state, the operation shaft 222 is urged to the right side in the X direction by the return spring 27, and the trigger 22 is separated from the switch housing 21. In conjunction with the movement of the trigger 22, the plunger 28 moves to the right in the X direction to turn the movable contact piece 241 clockwise. As a result, the end of the movable contact piece 241, at which the movable contact 24 is provided, is separated from the lower wall 215 of the switch housing 21, and the movable contact 24 is separated from the fixed contact 23 to come into the returned state illustrated in FIG. 7.

In the trigger switch 20, the vibration damping elastic bodies 26 is provided on the outer surface of the switch housing 21. Therefore, the vibration generated by the rotation of the motor of the electric power tool 1 or the like is absorbed by the vibration damping elastic body 26 disposed between the tool housing 10 and the switch housing 21, and vibration propagated to the trigger switch 20 via the tool housing 10 is suppressed, thereby enabling improvement in vibration resistance. It is thereby possible to prevent occurrence of chattering without increasing the contact pressure of the movable contact 24 with respect to the fixed contact 23. That is, it is possible to simultaneously achieve prevention of occurrence of chattering and reduction in wear between the fixed contact 23 and the movable contact 24.

The switch housing 21 has on its outer surface the tool housing fixing unit 261 that can be fixed to the tool housing 10, and the vibration damping elastic body 26 is provided in the tool housing fixing unit 261. As a result, the tool housing 10 and the switch housing 21 come into contact with each other via the vibration damping elastic body 26, thereby enabling reliable improvement in vibration resistance.

The switch housing 21 has a plurality of the tool housing fixing units 261, and the plurality of tool housing fixing units 261 are provided with the vibration damping elastic bodies 26 that are independent from each other. As a result, the installation area of the vibration damping elastic body 26 in the switch housing 21 can be minimized, so that the manufacturing cost of the trigger switch 20 can be reduced. In addition, even when the vibration damping elastic body 26 is formed of a material with a low heat dissipation property, by minimizing the installation area of the vibration damping elastic body 26 in the switch housing 21, heat radiation of the trigger switch 20 can be ensured.

The switch housing 21 has a rectangular box shape, and each of the plurality of vibration damping elastic bodies 26 is provided at each corner of the switch housing 21. Since this protects the corner of the trigger switch 20 which is liable to break, for example, even if the trigger switch 20 is erroneously dropped from a high position during a manufacturing process, breakage of the trigger switch 20 can be prevented.

Further, since the vibration damping elastic body 26 is an elastomer, it is possible to easily obtain the vibration damping elastic body 26 having elasticity according to the design.

Figure 9:
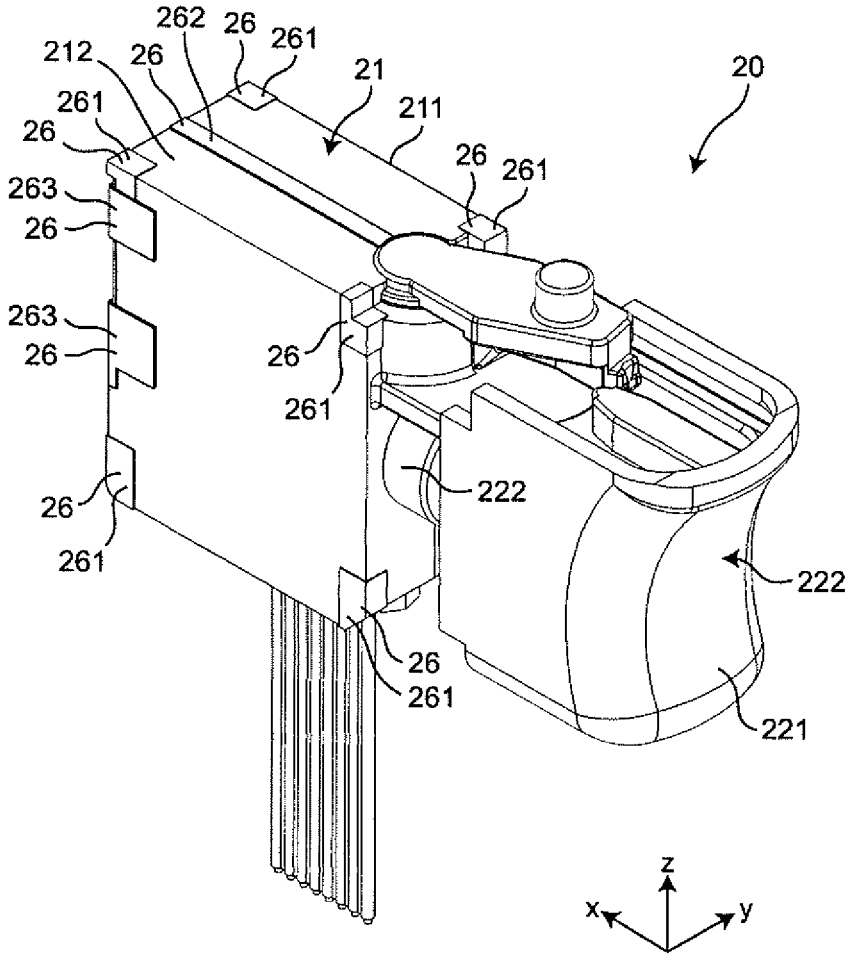
FIG. 9 is a perspective view illustrating a first example of the trigger switch in FIG. 5.

The vibration damping elastic body 26 is not limited to the tool housing fixing unit 261. For example, as illustrated in FIG. 9, the vibration damping elastic body 26 may be provided in a joining portion 262 between the first housing 211 and the second housing 212, and a joining portion 263 between the first housing 211 or the second housing 212 and the sub second housing 213, to cover the joining portion between the first housing 211 and the second housing 212. This enables improvement in water resistance of the trigger switch 20.

Figure 10:
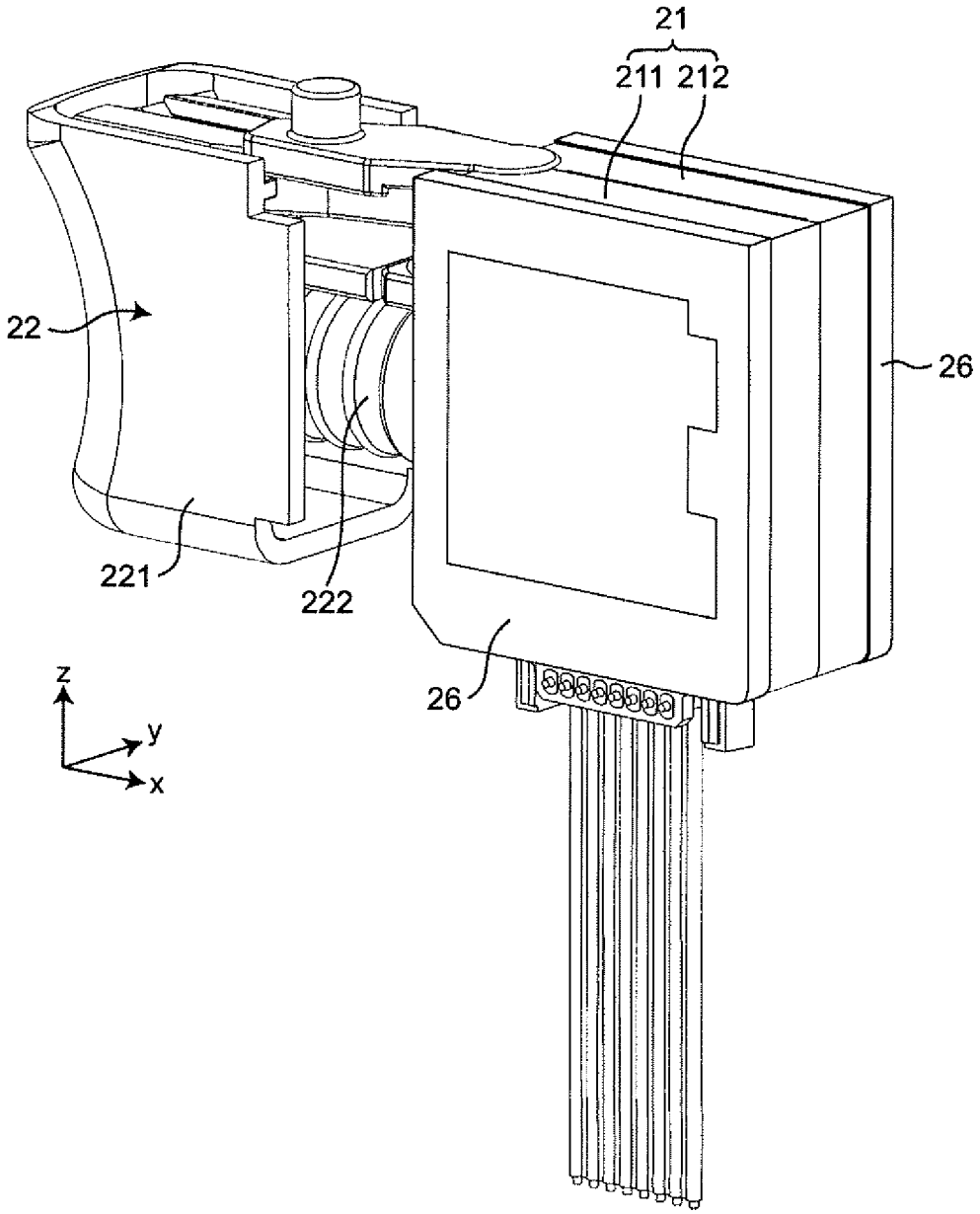
FIG. 10 is a perspective view illustrating a second example of the trigger switch in FIG. 5.

The vibration damping elastic body 26 is not limited to the case where the vibration damping elastic body 26 is provided only in the tool housing fixing unit 261 of the switch housing 21. For example, as illustrated in FIG. 10, the vibration damping elastic body 26 may be provided over the entire periphery of the edge of the surface facing in the width direction (i.e., the Y direction) of the switch housing 21.

In addition, the vibration damping elastic body 26 may have a single layer structure constituted by one elastic layer, or may have a laminated structure constituted by a plurality of elastic layers. That is, the vibration damping elastic body 26 is not limited to two-color molding, but can be provided by single layer molding or multilayer molding of three or more colors. The plurality of elastic layers constituting the laminated structure may have the same rigidity or may have different rigidities. For example, by forming the vibration damping elastic body 26 into a laminated structure with different rigid elastic layers combined, it is possible to deal with vibrations having different frequencies, amplitude, or the like, and improve the vibration damping force of the vibration damping elastic body 26.

In addition, the vibration damping elastic body 26 may be provided such that an area in a plan view along the direction orthogonal to the contact/separation direction (i.e., the Z direction in FIGS. 7 and 8) in which the movable contact 24 contacts and separates from the fixed contact 23 (i.e., a plan view seen from the Z direction in FIGS. 7 and 8) is larger than an area in a plan view along the contact/separation direction (i.e., a plan view seen from the X direction in FIGS. 7 and 8). Hence it is possible to more greatly damp the vibration in the contact/separation direction than the direction intersecting the contact/separation direction, and more reliably prevent occurrence of chattering.

According to the design of the tool housing 10 of the electric power tool 1, or the like, the tool housing fixing unit 261 can be provided in an arbitrary number and can be provided at an arbitrary position.

In addition, to prevent breakage of the trigger switch 20, the vibration damping elastic body 26 may be provided at at least two adjacent corners of the switch housing 21.

The present invention is not limited to the trigger switch 20 but can be applied to an arbitrary trigger switch including: a switch housing fixed inside a tool housing of an electric power tool and internally having a holder; a trigger provided outside the switch housing and connected to the switch housing so as to be approachable to and separable from the switch housing; a fixed contact provided in the holder; and a movable contact provided so as to face the fixed contact in the holder and configured to come into contact with and separate from the fixed contact in conjunction with an approaching motion and a separating motion of the trigger with respect to the switch housing.

For example, the present invention can be applied to a trigger switch configured such that a microcomputer and a printed circuit are provided in the holder 25, the printed circuit being mounted with a resistive body having a resistance value which fluctuates in conjunction with movement of a trigger (e.g., a resistance value decreases as the operating state becomes higher), and the microcomputer controls the rotation of the motor in accordance with the position of the trigger detected by a current flowing through the resistive body.

Various embodiments of the present invention have been described in detail with reference to the drawings, and lastly, various aspects of the present invention will be described.

A trigger switch of a first aspect of the present invention includes: a switch housing fixed inside a tool housing of an electric power tool and internally having a holder; an operation unit provided outside the switch housing and connected to the switch housing so as to be approachable to and separable from the switch housing; a fixed contact provided in the holder; and a movable contact provided so as to face the fixed contact in the holder and configured to come into contact with and separate from the fixed contact in conjunction with an approaching motion and a separating motion of the operation unit with respect to the switch housing. A vibration damping elastic body is provided integrally on an outer surface of the switch housing.

According to the trigger switch of the first aspect, the vibration damping elastic body is provided on the outer surface of the switch housing. Therefore, the vibration generated by the rotation of the motor of the electric power tool or the like is absorbed by the vibration damping elastic body disposed between the tool housing and the switch housing, and vibration propagated to the trigger switch via the tool housing is suppressed, thereby enabling improvement in vibration resistance.

In a trigger switch according to a second aspect of the present invention, the switch housing has, on an outer surface, a tool housing fixing unit configured to be fixed to the tool housing, and the vibration damping elastic body is provided in the tool housing fixing unit.

According to the trigger switch of the second aspect, the tool housing and the switch housing come into contact with each other via the vibration damping elastic body, thereby enabling reliable improvement in vibration resistance.

In a trigger switch according to a third aspect of the present invention, the switch housing has a plurality of the tool housing fixing units, and the plurality of tool housing fixing units are provided with the vibration damping elastic bodies that are independent from each other.

According to the trigger switch of the third aspect, the installation area of the vibration damping elastic body in the switch housing can be minimized, so that the manufacturing cost of the trigger switch can be reduced.

In a trigger switch according to a fourth aspect of the present invention, the switch housing has a rectangular box shape, and each of the plurality of vibration damping elastic bodies is provided at each corner of the switch housing.

According to the trigger switch of the fourth aspect, since the corner of the trigger switch, which is liable to break, is protected, for example, even if the trigger switch 20 is erroneously dropped from a high position during a manufacturing process, breakage of the trigger switch 20 can be prevented.

In a trigger switch according to a fifth aspect of the present invention, the switch housing is made up of a first housing having an opening on one surface and a second housing joined to the surface of the first housing to close the opening, and the vibration damping elastic body is provided in a joining portion between the first housing and the second housing and covers the joining portion.

According to the trigger switch of the fifth aspect, it is possible to improve the water resistance of the trigger switch.

In a trigger switch according to a sixth aspect of the present invention, the vibration damping elastic body has a laminated structure including a plurality of elastic layers.

According to the trigger switch of the sixth aspect, for example, by forming the vibration damping elastic body into a laminated structure with different rigid elastic layers combined, it is possible to deal with vibrations having different frequencies, amplitudes, or the like, and improve the vibration damping force of the vibration damping elastic body.

In a trigger switch according to a seventh aspect of the present invention, the vibration damping elastic body is an elastomer.

According to the trigger switch of the seventh aspect, it is possible to easily obtain a vibration damping elastic body having elasticity according to the design.

In a trigger switch of an eighth aspect of the present invention, an area of the vibration damping elastic body in a plan view along a direction orthogonal to a contact/separation direction in which the movable contact comes into contact with and separates from the fixed contact is larger than an area of the vibration damping elastic body in a plan view along the contact/separation direction.

According to the trigger switch of the eighth aspect, the vibration in the contact/separation direction can be more greatly damped than the direction intersecting the contact/separation direction, and the occurrence of chattering can be prevented more reliably.

Note that by appropriately combining freely selected embodiments or modifications of the above variety of embodiments and modifications, it is possible to achieve the respective effects of those combined. While it is possible to combine embodiments, combine examples, or combine an embodiment and an example, it is also possible to combine features in different embodiments or examples.

The present invention has been fully described in connection with the preferred embodiments with reference to the accompanying drawings, but various modifications or corrections will be apparent to those skilled in the art. Such modifications or corrections are to be understood as being included in the scope of the present invention according to the appended claims so long as not deviating therefrom.

The trigger switch of the present invention is not limited to the above-described embodiments, but can be applied to a trigger switch having another configuration.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

1 electric power tool
10 tool housing
11 right housing
12 left housing
13 drive mechanism holder
14 trigger switch holder
141 grip part
15 battery holder
16 trigger switch fixing unit
20 trigger switch
21 switch housing
211 first housing
212 second housing
213 sub second housing
214 opening
215 wall
22 trigger
221 operation body
222 operation shaft
23 fixed contact
231 fixed contact side terminal
24 movable contact
241 movable touch piece
242 support
243 movable contact side terminal
25 holder
26 vibration damping elastic body
261 tool housing fixing unit
262, 263 joining portion
27 return spring
28 plunger

The invention claimed is:

1. A trigger switch comprising:

a switch housing fixed inside a tool housing of an electric power tool and internally having a holder;

an operation unit provided outside the switch housing and connected to the switch housing so as to be approachable to and separable from the switch housing;

a fixed contact provided in the holder; and a movable contact provided so as to face the fixed contact in the holder and configured to come into contact with and separate from the fixed contact in conjunction with an approaching motion and a separating motion of the operation unit with respect to the switch housing, wherein a vibration damping elastic body is provided integrally on an outer surface of the switch housing, wherein the switch housing is made up of a first housing having an opening on one surface and a second housing joined to the surface of the first housing to close the opening, and wherein the vibration damping elastic body is provided in a joining portion between the first housing and the second housing and covers the joining portion.

2. The trigger switch according to claim 1, wherein the switch housing has, on an outer surface, a tool housing fixing unit configured to be fixed to the tool housing, and wherein the vibration damping elastic body is provided in the tool housing fixing unit.

3. The trigger switch according to claim 2, wherein the switch housing has a plurality of the tool housing fixing units, and wherein the plurality of tool housing fixing units are provided with the vibration damping elastic bodies that are independent from each other.

4. The trigger switch according to claim 3, wherein the switch housing has a rectangular box shape, and wherein each of the plurality of vibration damping elastic bodies is provided at each corner of the switch housing.

5. The trigger switch according to claim 1, wherein the vibration damping elastic body has a laminated structure including a plurality of elastic layers.

6. The trigger switch according to claim 1, wherein the vibration damping elastic body is an elastomer.

7. The trigger switch according to claim 1, wherein an area of the vibration damping elastic body in a plan view along a direction orthogonal to a contact/separation direction in which the movable contact comes into contact with and separates from the fixed contact is larger than an area of the vibration damping elastic body in a plan view along the contact/separation direction.

8. The trigger switch according to claim 2, wherein the switch housing is made up of a first housing having an opening on one surface and a second housing joined to the surface of the first housing to close the opening, and wherein the vibration damping elastic body is provided in a joining portion between the first housing and the second housing and covers the joining portion.

9. The trigger switch according to claim 3, wherein the switch housing is made up of a first housing having an opening on one surface and a second housing joined to the surface of the first housing to close the opening, and wherein the vibration damping elastic body is provided in a joining portion between the first housing and the second housing and covers the joining portion.

10. The trigger switch according to claim 4, wherein the switch housing is made up of a first housing having an opening on one surface and a second housing joined to the surface of the first housing to close the opening, and wherein the vibration damping elastic body is provided in a joining portion between the first housing and the second housing and covers the joining portion.

11. The trigger switch according to claim 2, wherein the vibration damping elastic body has a laminated structure including a plurality of elastic layers.

12. The trigger switch according to claim 3, wherein the vibration damping elastic body has a laminated structure including a plurality of elastic layers.

13. The trigger switch according to claim 4, wherein the vibration damping elastic body has a laminated structure including a plurality of elastic layers.

14. The trigger switch according to claim 5, wherein the vibration damping elastic body has a laminated structure including a plurality of elastic layers.

15. The trigger switch according to claim 2, wherein the vibration damping elastic body is an elastomer.

16. The trigger switch according to claim 3, wherein the vibration damping elastic body is an elastomer.

17. The trigger switch according to claim 4, wherein the vibration damping elastic body is an elastomer.

18. The trigger switch according to claim 5, wherein the vibration damping elastic body is an elastomer.

19. The trigger switch according to claim 5, wherein the vibration damping elastic body is an elastomer.

* * * * *